US009328894B2

(12) United States Patent
Falicoff et al.

(10) Patent No.: US 9,328,894 B2
(45) Date of Patent: May 3, 2016

(54) REMOTE PHOSPHOR LIGHT ENGINES AND LAMPS

(75) Inventors: Waqidi Falicoff, Stevenson Ranch, CA (US); Yupin Sun, Yorba Linda, CA (US); Will Shatford, Pasadena, CA (US); William Parkyn, Yorba Linda, CA (US)

(73) Assignee: Light Prescriptions Innovators, LLC, Altadena, CA (US)

( * ) Notice: Subject to any disclaimer, the term of this patent is extended or adjusted under 35 U.S.C. 154(b) by 661 days.

(21) Appl. No.: 12/910,532

(22) Filed: Oct. 22, 2010

(65) Prior Publication Data

US 2011/0096552 A1 Apr. 28, 2011

Related U.S. Application Data

(60) Provisional application No. 61/279,586, filed on Oct. 22, 2009, provisional application No. 61/280,856, filed on Nov. 10, 2009, provisional application No. 61/299,601, filed on Jan. 29, 2010, provisional application No. 61/333,929, filed on May 12, 2010, provisional application No. 61/264,328, filed on Nov. 25, 2009.

(51) Int. Cl.
*F21V 3/04* (2006.01)
*F21K 99/00* (2016.01)
(Continued)

(52) U.S. Cl.
CPC ..... *F21V 3/0481* (2013.01); *F21K 9/135* (2013.01); *F21K 9/56* (2013.01); *F21V 29/75* (2015.01); *F21Y 2101/02* (2013.01); *F21Y 2113/005* (2013.01)

(58) Field of Classification Search
CPC ..... F21Y 2101/02; F21V 29/004; F21V 7/09; F21V 7/00085; F21V 7/04; F21V 7/0025; F21V 7/85; F21V 7/25; F21K 9/00
USPC ..... 362/297, 249.02, 247, 800
See application file for complete search history.

(56) References Cited

U.S. PATENT DOCUMENTS 5,463,280 A * 10/1995 Johnson ..... 315/187
5,947,588 A * 9/1999 Huang ..... 362/235
(Continued)

FOREIGN PATENT DOCUMENTS

JP 2008-186758 A 8/2008
KR 10-2001-0069867 A 7/2001
(Continued)

OTHER PUBLICATIONS

International Search Report and Written Opinion for PCT/US2010/053748.
(Continued)

*Primary Examiner* — Jong-Suk (James) Lee
*Assistant Examiner* — Mark Tsidulko
(74) *Attorney, Agent, or Firm* — Drinker Biddle & Reath LLP

(57) ABSTRACT

A light engine has a pillar with first and second ends; a circuit board on the first end of the pillar, a light source mounted on the circuit board encircling the pillar and facing towards the second end of the pillar, and a surface extending from the second end of the pillar, that surface and the exterior of the pillar between that surface and the circuit board being coated with a reflective remote phosphor that is excited by light from the light source. The light engine may be used in a light bulb, with a frosted globe enclosing the circuit board and mounted round the outer edge of the phosphor-coated surface, and an Edison screw or other standard base connected to the second end of the pillar.

17 Claims, 7 Drawing Sheets

(51) Int. Cl.

| | |
|---|---|
| ***F21V 29/75*** | (2015.01) |
| *F21Y 101/02* | (2006.01) |
| *F21Y 113/00* | (2016.01) |

(56) References Cited

U.S. PATENT DOCUMENTS

| | | | | |
|---|---|---|---|---|
| 6,161,910 | A | 12/2000 | Reisenauer et al. | |
| 6,184,628 | B1 * | 2/2001 | Ruthenberg | 315/185 R |
| 6,635,987 | B1 | 10/2003 | Wojnarowski et al. | 313/498 |
| 7,040,776 | B2 | 5/2006 | Harrell et al. | |
| 7,150,553 | B2 * | 12/2006 | English et al. | 362/545 |
| 7,347,599 | B2 | 3/2008 | Minano et al. | 362/511 |
| 7,350,936 | B2 | 4/2008 | Ducharme et al. | 362/231 |
| 7,367,692 | B2 * | 5/2008 | Maxik | 362/307 |
| 7,479,662 | B2 | 1/2009 | Soules et al. | 257/98 |
| 7,575,329 | B2 * | 8/2009 | Bennett, Jr. | 353/43 |
| 7,600,882 | B1 | 10/2009 | Morejon et al. | 362/84 |
| 7,663,315 | B1 | 2/2010 | Hulse | 313/512 |
| 7,923,741 | B1 * | 4/2011 | Zhai et al. | 257/98 |
| 8,021,008 | B2 * | 9/2011 | Ramer | 362/84 |
| 2005/0068776 | A1 | 3/2005 | Ge | |
| 2007/0018181 | A1 | 1/2007 | Steen et al. | 257/98 |
| 2007/0081336 | A1 | 4/2007 | Bierhuizen et al. | 362/293 |
| 2007/0120135 | A1 | 5/2007 | Soules et al. | |
| 2008/0030993 | A1 | 2/2008 | Narendran et al. | 362/296 |
| 2008/0054281 | A1 | 3/2008 | Narendran et al. | 257/98 |
| 2008/0117500 | A1 | 5/2008 | Narendran et al. | 359/326 |
| 2009/0067179 | A1 | 3/2009 | Chaves et al. | 362/329 |
| 2009/0225529 | A1 | 9/2009 | Falicoff et al. | 362/84 |

FOREIGN PATENT DOCUMENTS

| | | | |
|---|---|---|---|
| KR | 10-2005-0046742 | A | 5/2005 |
| KR | 10-2006-0117612 | A | 11/2006 |
| KR | 20-2008-0006566 | U | 12/2008 |

OTHER PUBLICATIONS

N. Narendran, Y. Gu, J.P. Freyssinier-Nova, Y. Zhu, *Extracting phosphor-scattered photons to improve white LED efficiency*,—phys. Stat. sol. (a), vol. 202, No. 6, R 60-R 62 May 2005.

Anonymous, ip.Com Technical Disclosure No. IPCOM000176079D, *Remote Reflective Phosphor Lighting Device*, Nov. 4, 2008.

PCT/US2010/053758 International Search Report dated Jun. 27, 2011.

* cited by examiner

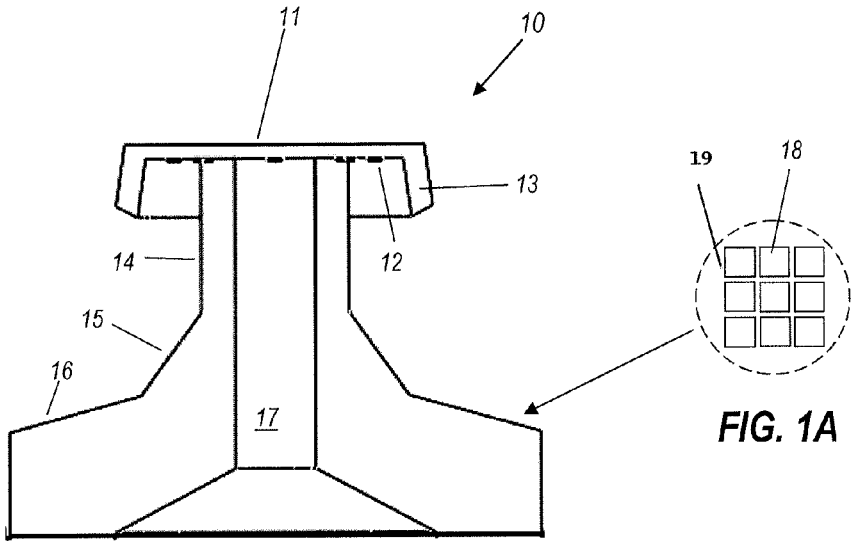
FIG. 1A
FIG. 1
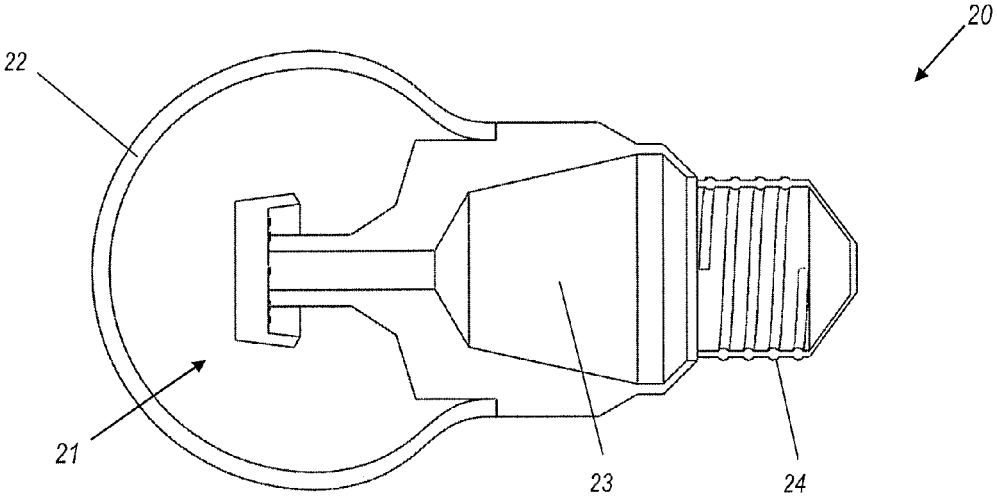
FIG. 2

REMOTE PHOSPHOR LIGHT ENGINES AND LAMPS

CROSS REFERENCE TO RELATED APPLICATIONS

This application claims benefit of: U.S. Provisional Application 61/279,586 filed Oct. 22, 2009 titled "Lamp" by several of the inventors; U.S. Provisional Patent Application 61/280,856, filed Nov. 10, 2009, U.S. Provisional Patent Application 61/299,601, filed Jan. 29, 2010, and U.S. Provisional Patent Application 61/333,929 filed May 12, 2010, all titled "Solid-State Light Bulb With Interior Volume for Electronics," all by some of the same inventors; and U.S. Provisional Application 61/264,328 filed Nov. 25, 2009 titled "On-Window Solar-Cell Heat-Spreader" by several of the inventors. All of those applications are incorporated herein by reference in their entirety.

Reference is made to co-pending and commonly owned U.S. patent applications Ser. No. 12/378,666 (publication no. 2009/0225529) titled "Spherically Emitting Remote Phosphor" by Falicoff et al., Ser. No. 12/210,096 (publication no. 2009/0067179) titled "Optical Device For LED-Based Lamp" by Chaves et al, and Ser. No. 12/387,341 (publication no. 2010/0110676) titled "remote phosphor LED downlight." All of those applications, which have at least one common inventor to the present application, are incorporated herein by reference in their entirety. Reference is made to co-pending U.S. patent applications Ser. No. 12/778,231 titled "Dimmable LED Lamp," filed May 12, 2010, Ser. No. 12/589,071 (publication no. 2010-0097002), titled "Quantum Dimming via Sequential Stepped Modulation" filed Oct. 16, 2009, and Ser. No. 12/910,511 (publication no. 2011-0095686), titled "Solid state light bulb," filed Oct. 22, 2010, all by several of the inventors. All of those applications, which have at least one common inventor to the present application, are incorporated herein by reference in their entirety.

BACKGROUND OF THE INVENTION

The term 'solid state lighting' (SSL) is more than just a synonym for the use of light-emitting diodes, since it also comprises circuit boards, dimming and color control, power supplies, heat sinks, and secondary optics. In large installations, the lights are spread out with controls and power supply separately located, typically without tight volume-constraints. In a retail lighting product, however, all the subsystems must fit within a standard envelope, meaning very tight constraints on weight and cost but most importantly on volume. In particular, a lamp that is intended to substitute for a conventional incandescent light bulb in existing fittings, such as the A-19 light bulb with medium Edison screw fitting that is common in the U.S.A., has relatively severe geometric constraints, on top of the generic difficulty of generating spherical output with inherently planar LED emission. One objective of the present invention is to provide a complete solid-state light bulb, within an Edison-base A-19 envelope, a PAR-lamp, or comparable envelopes that are used in other territories or for other purposes.

SUMMARY OF THE INVENTION

Due to their high filament temperatures, the exterior of incandescent A-19 light bulbs is entirely made of glass, typically diffuse, except for the metallic base. However, glass is brittle, and the thin envelope of a conventional light bulb is somewhat fragile. Except for their base, embodiments of the lamps of the present invention can have a plastic exterior, which can be tougher than glass, and so can be inherently rugged. Embodiments of the present invention produce white light by a combination of blue LED chips and a geometrically separate reflective remote phosphor that converts most of the blue light to yellow.

A "remote" phosphor is one that is spaced apart from the LED or other excitation light source, in contrast to the common conformal phosphor, coated onto the encapsulant immediately covering the actual LED chip. Various benefits of the remote phosphor approach are taught in earlier U.S. patents and applications by several of the same inventors, including U.S. Pat. No. 7,286,296 to Chaves et al. There are two primary types of remote phosphor: transmissive and reflective. In a "transmissive" phosphor, the useful light emerges on the side of a phosphor layer away from the excitation light source. In a "reflective" phosphor, the useful light emerges on the side of the phosphor layer towards from the excitation light source. A reflective phosphor may be of similar composition to a transmissive phosphor, and may both transmit and reflect unconverted blue light, and may emit converted yellow light both forwards and backwards. The reflective phosphor is then typically applied as a coating on a highly reflective substrate, either diffuse or specular, that returns transmitted and forward emitted light back through the phosphor layer. Solid state lights based on the transmissive remote phosphor approach have been commercialized but the reflective approach has up to this time not made it to the marketplace. In U.S. Pat. No. 7,665,858, by several of the same inventors as this one, a reflective remote phosphor is shown that is color temperature tunable. Although the approach works it is also expensive and fairly complex to build. The present invention provides alternative approaches which are less expensive and more commercially viable for a wider range of applications.

With currently available blue LEDs and yellow phosphors, the phosphor by itself will reflect about 10% of the blue light hitting it, whereas about 25% of the final white light must be the original blue wavelengths. It is possible, though exacting, to adjust the thickness of a reflection-mode phosphor on a reflective backing to get the proper amount (−15%) of unabsorbed blue light scattered out from within it. Instead, for some embodiments of the present invention it is advantageous to apply the phosphor in patches so as to leave uncovered white surface between them, as taught in co-pending application Ser. No. 12/387,341.

One embodiment of the present invention comprises an LED light engine, to be utilized with either of two secondary optical elements. The shape of the optic can be either a conventional A-19 frosted light bulb or a PAR-19 lamp, either of which can be on an Edison-style screw-in base or other conventional base. The LEDs are on a circuit board facing this base, with the reflective remote phosphor receiving all of the light from the LEDs, with none of the LED's light directly shining upon the secondary optic. The remote phosphor is on a surface that is a part or all of a hemispheric cavity, depending upon the secondary optic. The remote phosphor and the white surface upon which it is deposited are both highly diffuse reflectors, with much of their emission falling on other parts of the remote phosphor. This self-illumination and the resulting light-mixing will help assure uniform luminance and chrominance of the white light coming off the remote phosphor.

BRIEF DESCRIPTION OF THE DRAWINGS

The above and other aspects, features and advantages of the present invention will be apparent from the following more particular description thereof, presented in conjunction with the following drawings wherein:

FIG. 1 is a cross-sectional view of a first preferred embodiment of a remote-phosphor light engine.

FIG. 1A is a close up of dispersed phosphor patches.

FIG. 2 is a cross-sectional view of a lamp based upon the light engine of FIG. 1.

DETAILED DESCRIPTION OF THE PREFERRED EMBODIMENTS

Figure 3A:
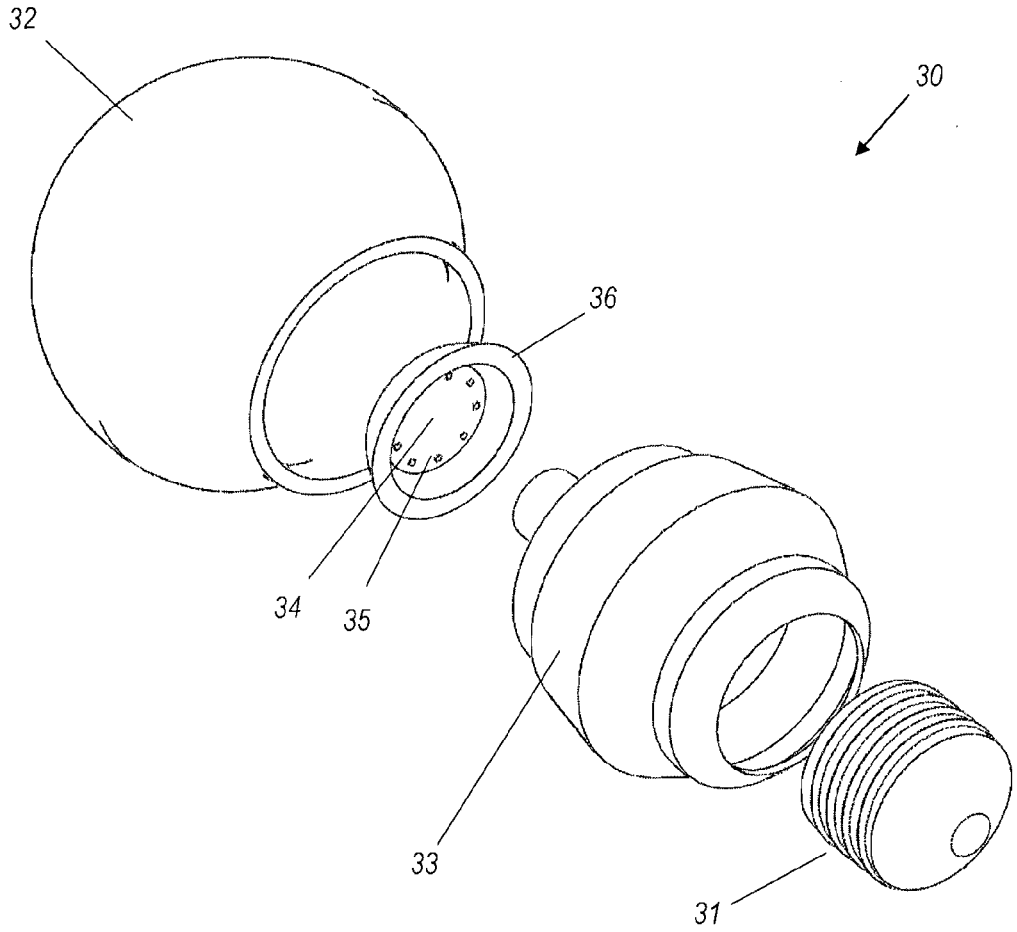
FIG. 3A shows a perspective exploded view of a lamp similar to that of FIG. 2.

A better understanding of various features and advantages of the present invention may be obtained by reference to the following detailed description of embodiments of the invention and accompanying drawings, which set forth illustrative embodiments in which certain principles of the invention are utilized.

FIG. 1 shows a somewhat schematic cross sectional view of light engine 10, comprising circuit board 11 with LED chips 12 mounted on it, lateral light-shield 13, vertical reflective remote-phosphor surface 14, inner slanted reflective remote-phosphor surface 15, outer slanted reflective remote-phosphor surface 16, and electronics via 17. There are eight LED chips 11 arranged in a circle surrounding a central hollow stalk, which has vertical remote-phosphor surface 14 on its outside and the hollow center of which forms electronics via 17. The LED chips 11 emit blue light. The blue light falls on the remote-phosphor surfaces or on shield 13, which is highly reflective, as are all exterior surfaces of light engine 10. The lower edge of shield 13 is positioned so that it just prevents direct rays from LEDs 12 missing the outer edge of outer slanted remote-phosphor surface 16 and escaping. The remote phosphor surfaces have a microstructure shown in the close-up view of FIG. 1A, with phosphor patches 18 on a highly reflective white substrate 19. The areas of white substrate exposed between the phosphor patches increase the proportion of blue LED light that is reflected without being converted to yellow by the phosphor. The overall color temperature of the light from the phosphor surfaces can thus be controlled by controlling the ratio of the areas of the phosphor patches and the exposed white substrate. It can be seen that each remote-phosphor surface shines onto the other two, helping to make them more uniform in brightness and color.

In order to improve the color rendering, the LEDs 12 may include red or other colored LEDs mixed in with the blue LEDs. An alternative approach to achieving a high CRI is to use more than one phosphor, especially a tri-phosphor mix such as the one taught in co-pending application No. Ser. 2011-0095686 . This can he used in the above approach of FIG, 1A with a patterned phosphor layer, or where the phosphor layer is continuous. In the latter case, the thickness of the reflective remote phosphor must be controlled to allow the required amount of reflected unconverted blue to be mixed with the phosphor converted light.

FIG. 2 shows lamp 20 in the A-19 configuration, with light engine 21 of the type shown in FIG. 1, frosted globe 22, Edison-style screw-in base 24, and electronics bay 23 in the lower part of the lamp between frosted globe 22 and screw-in base 24. Globe 22 has a rough interior surface with a significant amount of backscattering, as well as diffusing outgoing transmitted light, a property that helps give the globe a uniform lit appearance. Edison-style screw-in base 24 serves in the conventional way for power supply and mechanical mounting of the lamp 20, and can of course be substituted with a different sort of base to suit the receptacles available in a particular environment. Electronics bay 23 is connected to circuit board 11 through via 17.

The electronics and electrical wiring may be conventional, and in the interests of clarity are not shown in detail. The electronics serve at least to convert the power received through Edison-style screw-in base 24, which in the U.S.A. is typically 110 V, 60 Hz AC, and in other parts of the world may be, for example, 220 V, 50 Hz AC, to the supply required for the LEDs, which is typically about 3 V DC, or 24 V for 8 LEDs wired in series, with regulated current. More sophisticated control of the LEDs may be provided, such as the traditional dimming approaches such as pulse width and current modulation and the novel approach taught in Ser. No. 12/589,071 which does so-called quantum dimming, where the LEDs are individually controlled.

Because the physics of the Stokes shift in a phosphor inevitably produces significant waste heat, the body of the light engine on which the phosphor 14, 15, 16 is applied may be made of a heat-conducting metal or ceramic material that will conduct heat from the phosphor to the part of the exterior of the body exposed between the globe 22 and the base 24. From there, the heat can be radiated or conducted to the surrounding air, and dissipated by convection. Similarly, the stalk or pillar can conduct heat away from the LEDs 12 on circuit board 11 to the body for dissipation.

FIG. 3A shows a perspective exploded view of a lamp 30 similar to that shown in FIG. 2, comprising screw-in Edison base 31, frosted globe 32, lower body containing electronics bay 33, circuit board 34 bearing LED chips 35, and light shield 36.

Figure 3B:
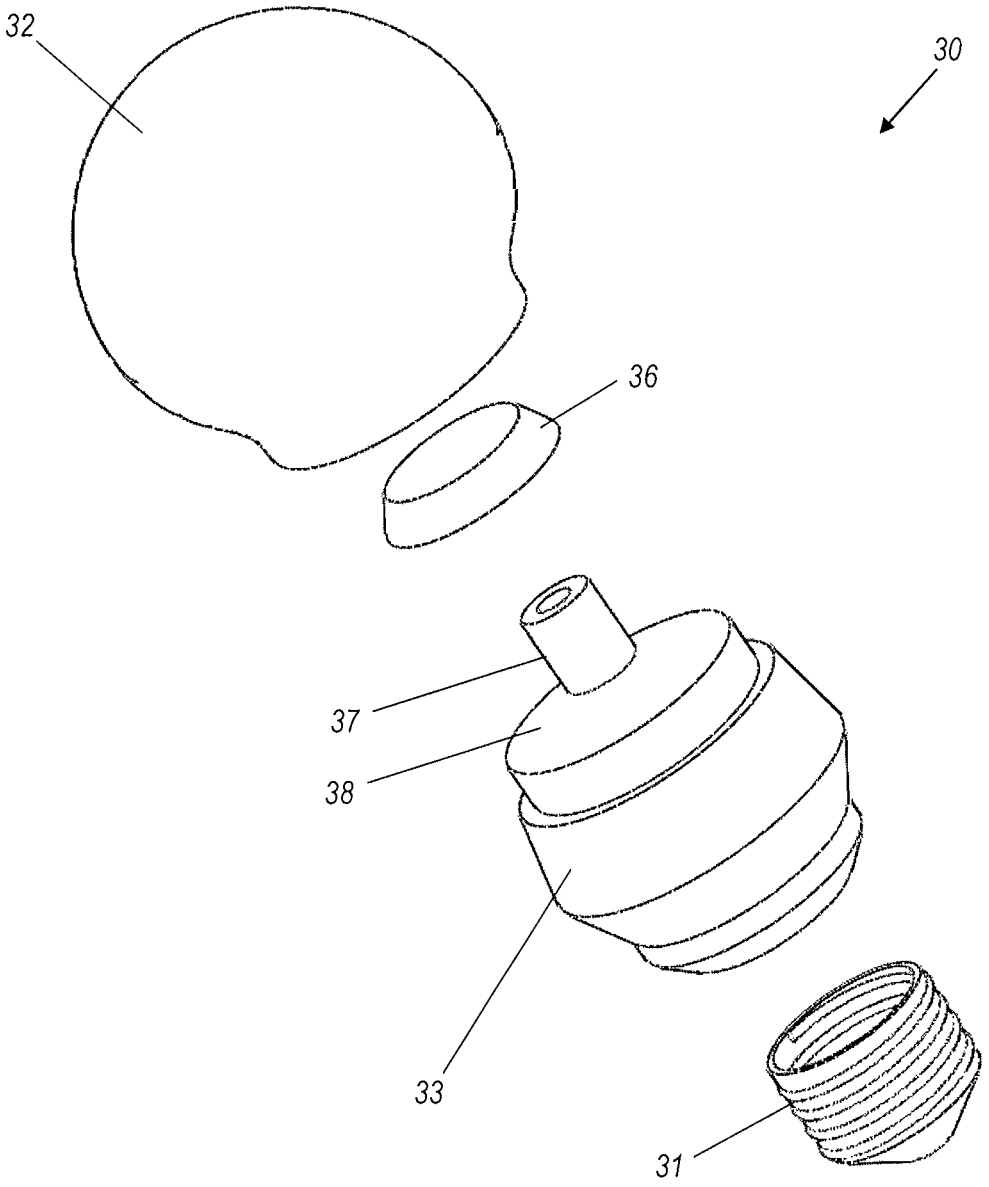
FIG. 3B shows another perspective exploded view of the lamp of FIG. 2.

FIG. 3B shows another perspective exploded view of lamp 30, also showing remote phosphor surfaces 37 and 38. As may be seen from FIG. 3B, lamp 30 does not have a distinct inner slanted remote-phosphor surface between vertical remote-phosphor surface 14 and outer slanted remote-phosphor surface 16. Other configurations are of course also possible.

Figure 3C:
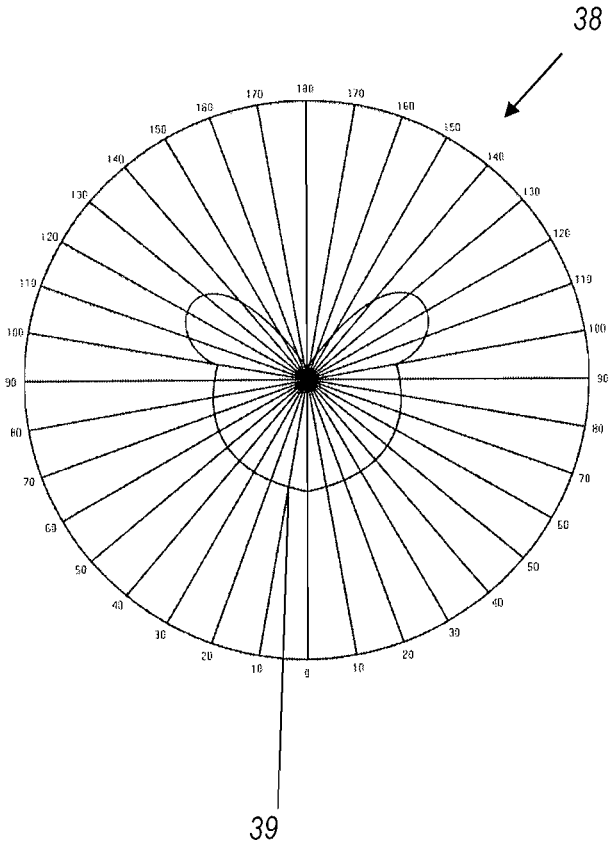
FIG. 3C shows an Isocandela plot of an embodiment of the lamp of FIG. 2.

FIG. 3C shows a simulated isocandela plot 38 for an embodiment of lamp 30 with plot contour 39. This plot was generated by the Inventors using the commercial ray-trace package TracePro. The simulation assumed the phosphor layers completely covered the exposed surfaces 14, 15, and 16 of FIG. 1. A tri-phosphor formulation comprising:

- Epoxy matrix: Masterbond UV 15-7, specific gravity of 1.20
- And per gram of Masterbond UV 15-7 epoxy:
- red phosphor (PhosphorTech buvr02, a sulfoselenide, mean particle size less than 10 microns, specific gravity of about 4): 21.1 ±0.03 mg.
- yellow phosphor (PhosphorTech byw01a, Ce-YAG, mean particle size 9 microns, specific gravity 4): 60.7 ±0.3 mg.

green phosphor (Intematix g1758, an Eu doped silicate, mean particle size 15.5 microns, specific gravity 5.11): 250.6 ±1.3 mg, (taught in the afore-mentioned co-pending patent application Ser. No. 2011-0095686 was used to determine the bulk scattering coefficient and other required parameters in the simulation.. The isocandela plot is sufficiently uniform to meet current U.S Energy Star standards.

Figure 4A:
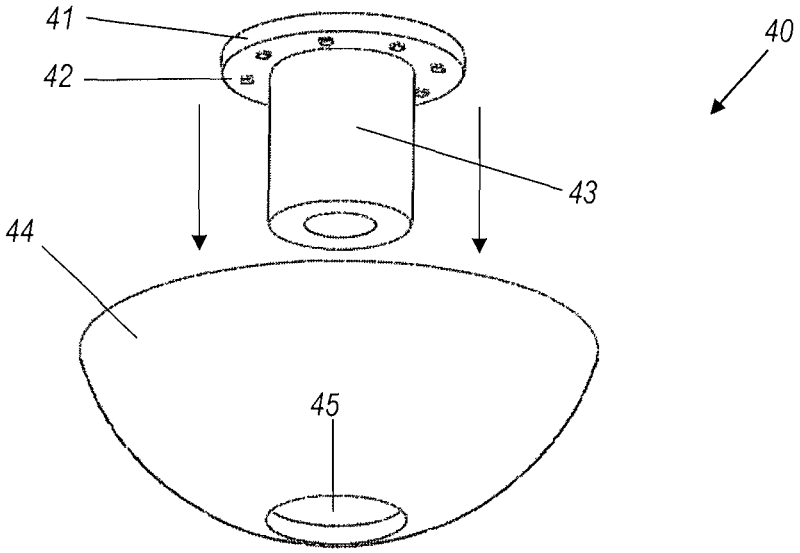
FIG. 4A shows an exploded perspective view from the rear of a second preferred embodiment of a light engine.
Figure 4B:
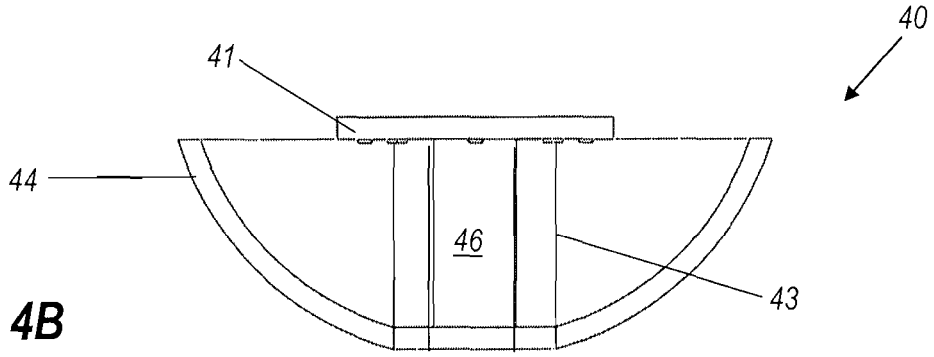
FIG. 4B shows an assembled cross-section side view of the light engine of FIG. 4A.
Figure 4C:
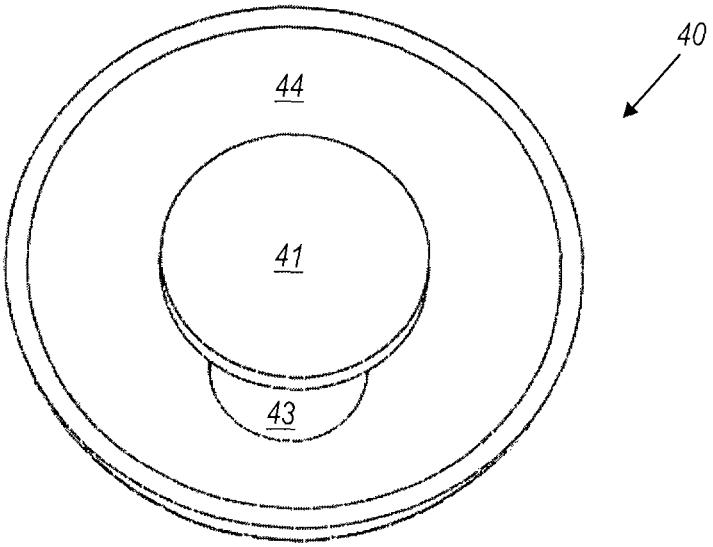
FIG. 4C shows a perspective front view of the light engine shown in FIG. 4B.

It is possible to alter the light engine of FIG. 1 or FIG. 3B by laterally extending the remote-phosphor surfaces 13, 14, and 15 or 37 and 38 with more remote-phosphor surface that extends outward back up to make a complete cup and reduce or eliminate any need for the light shield 13 or 36. FIGS. 4A, 4B, and 4C, collectively FIG. 4, show various views of this concept.

FIG. 4A shows an exploded view of light engine 40, comprising circuit board 41 with a ring of eight LEDs 42, pillar 43 with reflective remote phosphor on its exterior, and hemispheric cup 44 with reflective remote phosphor on its interior and aperture 45 at its bottom, receiving pillar 43.

FIG. 4B is a lateral cross-section of light engine 40, showing circuit board 41, LED chips 42, pillar 43, hemispheric cup 44, and electronics via 46 within pillar 43. As is best seen from FIG. 4B, the rim of cup 44 is flush with the lower or rear face of circuit board 41, on which the LEDs 42 are mounted. Assuming a hemispherical emission from LEDs 42, cup 44 just intercepts all of the direct rays from LEDs 42, so that no light shield 13, 36 is required.

FIG. 4C is a perspective front view of light engine 40, showing circuit board 41, pillar 43, and the remote-phosphor surface of cup 44. The view around circuit board 41 is only of remote-phosphor surfaces.

Figure 5:
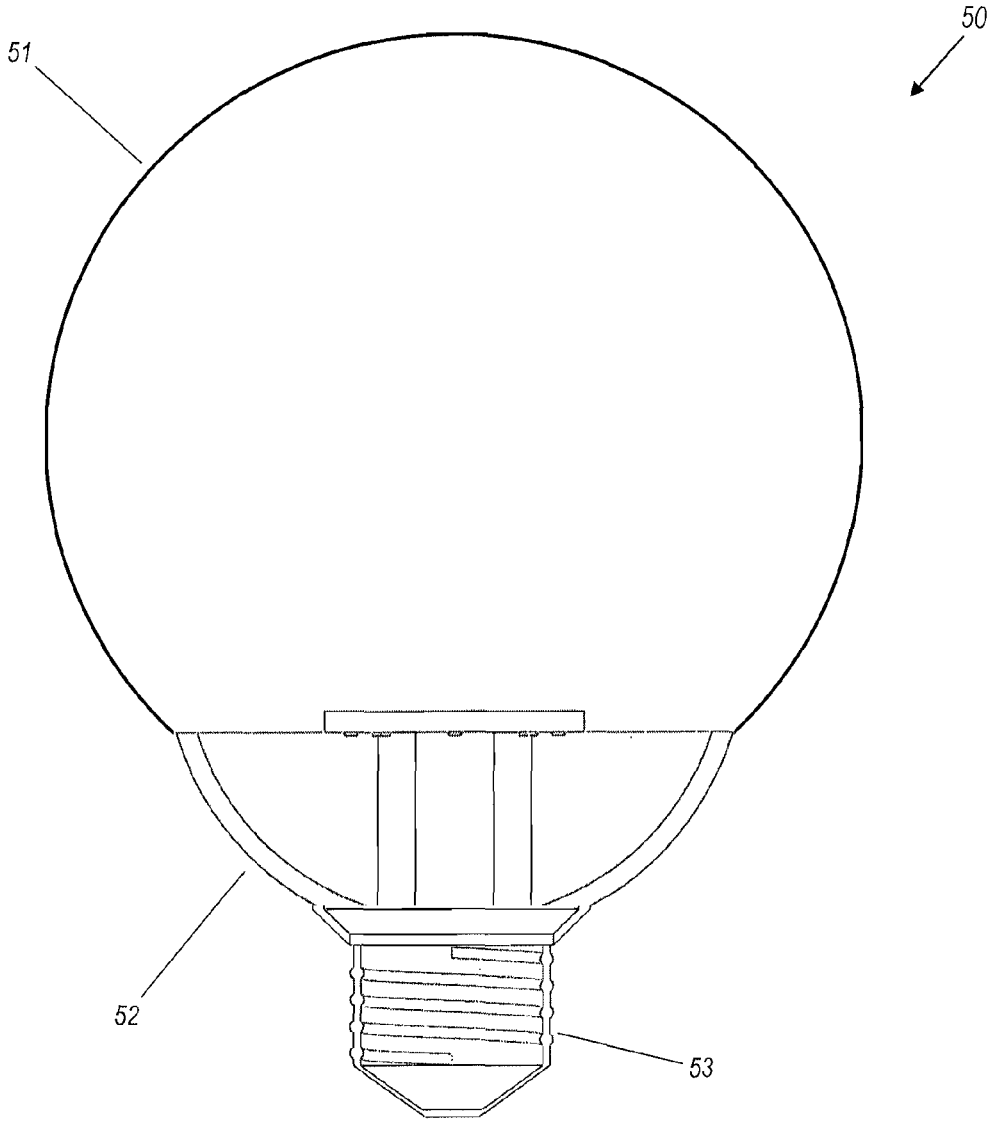
FIG. 5 shows a cross-sectional side view of a lamp with the light engine of FIG. 4B.

FIG. 5 shows a cross section of lamp 50, comprising frosted globe 51, light engine 52 of the type shown in FIG. 4, and Edison-style screw-in base 53. The light engine 52 shines from a chord of frosted globe 51, assuring that it globe 51 is comparatively uniformly illuminated. Although globe 51 still needs to be diffusely transmitting, globe 51 need not have any backscattering, unlike the frosted globe of FIG. 2. The light engine of FIG. 4 needs no further mixing, unlike that of FIG. 1, in which the uniformity of the output can be improved by some modest mixing by backscattering off the inside of its globe.

Figure 6:
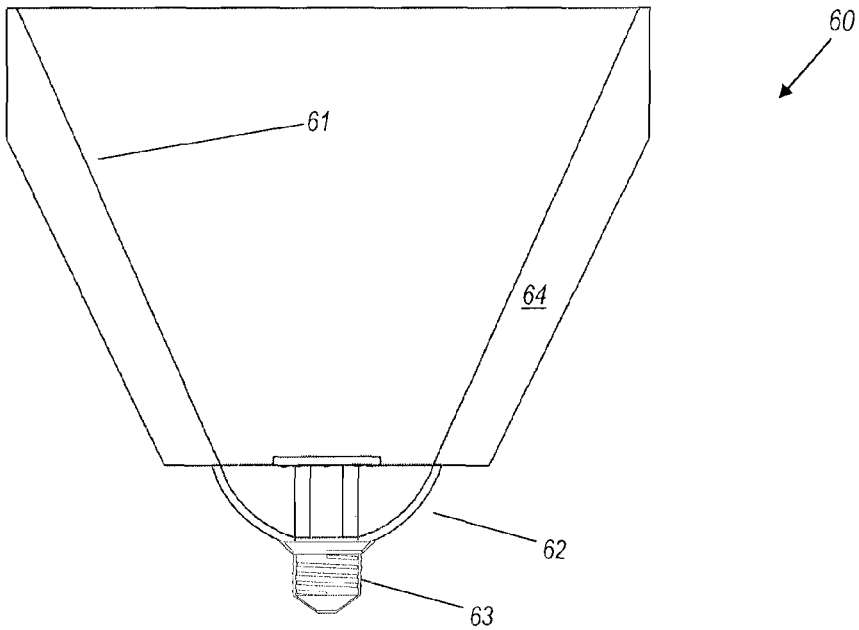
FIG. 6 shows a cross-sectional side view of a PAR lamp with the light engine of FIG. 4B.

FIG. 6 shows PAR lamp 60, comprising conical mirror 61, with a 23° opening half-angle, light engine 62 similar to that shown in FIG. 4, Edison-style screw-in base 63, and heat-dissipating fins 64.

Figure 7:
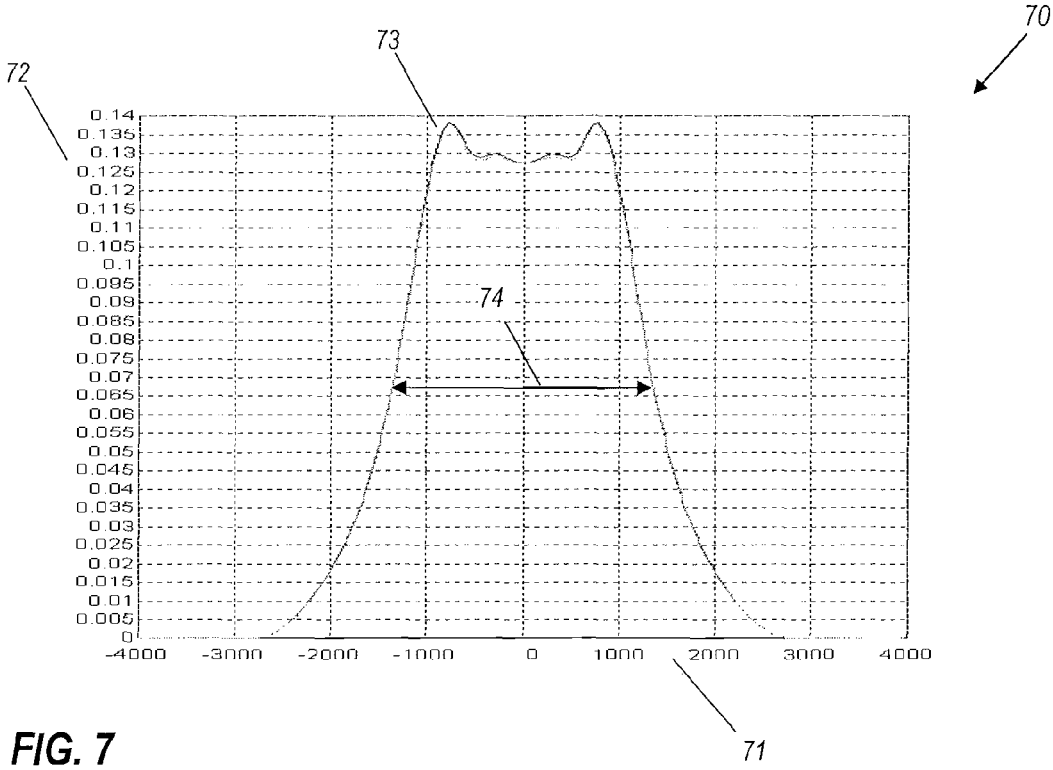
FIG. 7 shows a graph of light intensity against distance off axis for a lamp similar to that of FIG. 6.

FIG. 7 shows the exemplary illumination performance of the PAR lamp of FIG. 6, with graph 70 of lux at a distance of 3 meters, comprising abscissa 71 in mm off-axis and ordinate 72 in lux per lumen of lamp output. The curve in FIG. 7 was calculated using TracePro. Curve 73 is quite smooth, corresponding to a full width 74 at half-maximum of 50°, typical for a PAR lamp.

Although the reflective remote-phosphor surfaces of the present invention are much larger than the LED chips illuminating them, their cost is modest in comparison to the eight LEDs. For 18 square centimeters of phosphor area, a YAG-only phosphor with a color-rendering index around 75 costs only US$0.20 while a high-CRI triple-species phosphor with a color-rendering index of 92 costs about US$1.20, roughly the cost of a single LED chip, and considerably less than the cost of the high-flux packages LEDs commercially available at the time of this invention, typically US$2 to US$4 in high volume.

Although specific embodiments have been described, the skilled reader will understand how features of different embodiments may be combined, and how features of various embodiments may be modified or varied.

For example, the bulb 20 shown in FIG. 2 has a substantial body with an electronics compartment 23 between the frosted globe 22 and the connector base 24. The bulb 50 shown in FIG. 5 does not have an electronics compartment 23, but the interior 46 of the pillar 43 and the interior of the Edison screw base 53 are available for electronics. Either configuration of space for electronics, or anything in between, may be used in any of the embodiments. The optimum choice will be guided by the compactness of the available or required electronics and the available space within a light fitting into which the bulb 20, 50, etc. is to be fitted. However, embodiments of the invention comply fully with the external dimensions specified in the standard for the A19 bulb.

The diameter of the hollow interior 46 of the pillar 43 may also be varied within limits but in general it is preferred, as shown in FIG. 4B, for the height of the pillar between the circuit board 41 and the inside of the bowl 44 to be at least equal to the diameter of the ring of LEDs 42, to allow space for the light from the LEDs to spread out and illuminate the phosphor relatively evenly. Another approach that is possible is to have the driver electronics in a package remote from the lamp or downlight. This is certainly possible in a downlight and is currently an approach used in many solid state products currently on the market. For example, the Edison screw base of the bulb of FIG. 5 can be replaced by a mounting feature and the driver/power supply can be located in a remote location. This would be useful for a candelabra where the driver/power supply provides power for more than one lamp. Alternatively, the Edison screw base of FIG. 6 can be replaced by a GU24 or other connector to meet the requirements of certain municipality, state or Federal regulations. (The GU24 "twist and lock" connector is being promoted in the U.S.A. as a successor to the Edison screw. The intention is that it shall be a general standard for self-contained high-efficiency lamps, but that incandescent bulbs and other low efficiency lamps shall not be available with the GU24 fitting.)

For example, FIGS. 2 and 3B show a succession of convex cylindrical or frustoconical phosphor coated surfaces. FIG. 4B shows a cylindrical phosphor coated surface 43 on the pillar and a concave, hemispherical phosphor coated surface on the bowl 44. Other configurations are possible, such as a bowl 44 with two or more distinct surfaces, which may comprise flat surfaces, concave frustoconical surfaces, and/or surfaces curved as seen in axial cross-section.

For convenience of description, terms of relative orientation have been used in the description, with the end of the bulb having the mounting screw generally referred to as the base, bottom, or rear. However, all of the lamps shown in the embodiments may of course be used, mounted, or stored in any orientation.

The preceding description of the presently contemplated best mode of practicing the invention is not to be taken in a limiting sense, but is made merely for the purpose of describing the general principles of the invention. The full scope of the invention should be determined with reference to the Claims.

We claim:

1. A light engine comprising: a pillar with first and second ends; a circuit board on the first end of the pillar; a light source mounted on the circuit board encircling the pillar and facing towards the second end of the pillar, said light source facing towards the second end of the pillar being the only light source on said pillar; and a surface extending from the second end of the pillar, said surface and the exterior of the pillar between said surface and said circuit board being coated with a reflective remote phosphor that is excited by light from said light source;

wherein said surface comprises:

an inner slanted surface extending from the second end of the pillar radially outward and axially in the direction from the first end of the pillar towards the second end of the pillar; and an outer slanted surface extending from an outer edge of the inner slanted surface radially outward and axially in the direction from the first end of the pillar towards the second end of the pillar at a flatter angle than the inner slanted surface.

2. The light engine of claim 1, wherein said light source encircling said pillar is a ring of light emitting diodes.

3. The light engine of claim 2, wherein said pillar extends upwards at least a distance of the diameter of said ring, and said pillar is hollow.

4. The light engine of claim 3, further comprising a light shield surrounding said circuit board and extending upwards from a periphery of said circuit board, said light shield diffusely reflecting onto said reflective remote phosphor all light from said light emitting diodes. that does not shine directly on said reflective remote phosphor.

5. The light engine of claim 3, comprises a cup, wherein the rim of said cup is even with the plane of said circuit board and spaced apart from said circuit board to permit light from said reflective remote phosphor to leave the light engine, said laterally extending surface does not continue beyond said rim without a break, and wherein said cup has a reflective remote phosphor on its interior surface.

6. The light engine of claim 5, further comprising a conical mirror opening downward from said rim and an Edison-style screw-in base joined to said pillar.

7. The light engine of claim 3, further comprising a frosted globe centered on said circuit board and receiving all the light from said reflective remote phosphor, the frosted globe permitting light from said reflective remote phosphor to leave the light engine through the frosted globe between the circuit board and the second end of the pillar.

8. The light engine of claim 7, further comprising an electronics bay joined to said pillar and an Edison-style screw-in or GU24 twist-and-lock base.

9. The light engine of claim 3, wherein the phosphor coating comprises an array of phosphor patches on a highly reflective white substrate that is exposed between the phosphor patches.

10. The light engine of claim 1, wherein said pillar is hollow and electrical power is supplied to said light source through the interior of said pillar.

11. The light engine of claim 1, further comprising a light shield surrounding said circuit board and extending from a periphery of the circuit board towards said surface, said light shield diffusely reflecting onto said remote phosphor all light from LEDs that does not shine directly on said reflective remote phosphor.

12. The light engine of claim 1, comprises a cup, the rim of said cup is even with the plane of said circuit board and spaced apart from said circuit board to permit light from said reflective remote phosphor to leave the light engine, said laterally extending surface does not continue beyond said rim without a break, and said cup is coated with said reflective remote phosphor on its interior surface.

13. The light engine of claim 12, further comprising a reflector that opens from said rim in the direction from said second end towards said first end and a base compatible with a standard lighting receptacle joined to said second end of said pillar.

14. The light engine of claim 1, further comprising a frosted globe enclosing said circuit board, receiving the light from said reflective remote phosphor, and permitting light from said reflective remote phosphor to leave the light engine through the frosted globe between a plane of the circuit board and the second end of the pillar.

15. The light engine of claim 14, further comprising an electronics bay joined to said pillar and a base compatible with a standard lighting receptacle.

16. The light engine of claim 1, wherein the phosphor coating comprises an array of phosphor patches on a highly reflective white substrate that is exposed between the phosphor patches.

17. A lamp comprising the light engine of claim 1 and permitting light to leave the lamp radially from the inner and outer slanted surfaces throughout a region from a plane of an outer edge of the outer slanted surface towards the first end.

* * * * *